US006041742A

United States Patent [19]

Drake

[11] Patent Number: 6,041,742

[45] Date of Patent: Mar. 28, 2000

[54] FLUID HEATING AND PUMPING APPARATUS

[76] Inventor: Lawrence V. Drake, P.O. Box 717, Loveland, Colo. 80539-0717

[21] Appl. No.: 09/261,588

[22] Filed: Mar. 3, 1999

[51] Int. Cl.[7] ..... F22B 5/00

[52] U.S. Cl. ..... 122/13.1; 122/451 R; 126/361; 126/344; 220/723

[58] Field of Search ..... 122/13.1, 451, 122/451.1, 451.2, 452, 451 R; 126/361, 344; 220/723; 137/565.34, 593; 138/30

[56] References Cited

U.S. PATENT DOCUMENTS

| | | | |
|---|---|---|---|
| 4,098,434 | 7/1978 | Uhlig | 222/94 |
| 4,545,524 | 10/1985 | Zelczer | 236/46 R |
| 4,645,125 | 2/1987 | Omori | 237/12 |
| 4,817,830 | 4/1989 | Yavorsky | 222/386.5 |
| 5,555,997 | 9/1996 | Nogles | 220/404 |
| 5,584,316 | 12/1996 | Lund | 137/337 |
| 5,690,061 | 11/1997 | Lopez | 122/17 |

*Primary Examiner*—Harold Joyce
*Assistant Examiner*—Jiping Lu
*Attorney, Agent, or Firm*—William E. Hein

[57] ABSTRACT

A fluid heating and pumping apparatus for use with hot fluid space heating systems includes a fluid tank containing heated fluid and a collapsible bladder contained within the fluid tank for absorbing expansion of the fluid within the fluid tank as it is heated. An air venting device is mounted at a high point in the fluid tank to discharge any air as the heating system is filled with fluid and operated. A fluid circulating impeller, volute, and pressure bypass valve apparatus are also contained within the fluid tank and are connected to an outlet in the fluid tank through which heated fluid is pumped to heat transfer components of a space heating system. A fluid mixing apparatus is attached to the fluid circulating impeller to mix heated fluid from the fluid tank with cooled fluid returned from the heat transfer components to thereby provide fluid having a desired temperature.

5 Claims, 3 Drawing Sheets

FLUID HEATING AND PUMPING APPARATUS

FIELD OF THE INVENTION

This invention relates generally to hydronic heating systems of the type that utilize a flowing heated fluid to transfer heat from a heat source to a selected environment and, more particularly, to a fluid heating and pumping apparatus for use in such systems.

BACKGROUND AND SUMMARY OF THE INVENTION

Fluid heating systems, such as hot water heating units, have been used to provide heat to selected spaces. Radiators, fan coils, and tubes located in floors or ceilings have been used to transfer heat from a fluid to the air in the surrounding environment. These devices require different fluid temperatures for proper operation. Fluid heating apparatus, expansion tanks, pumps, pressure balancing valves, fluid mixing devices, and air eliminators have all been separate units which have required plumbing connections usually installed on the job site. These units are typically constructed to be quite heavy to withstand fluid pressures of 100 psi or more. Proper design and installation procedures are required to avoid trapped air in pumps and other components of the heating system.

It would be advantageous to provide a fluid heating system that eliminates much of the piping and the air elimination devices, as well as the external expansion tank, fluid mixing valves, and circulator pumps required in prior art systems.

In accordance with the illustrated preferred embodiment of the present invention, a fluid heating and pumping apparatus includes a fluid tank able to withstand internal fluid pressures associated with conventional water heaters and a method of heating the fluid contained therein. Heated fluid is circulated from an outlet pipe on the fluid tank, through the environment heating circuit, and back to an inlet pipe on the fluid tank. A threaded opening is provided at the top of the fluid tank to receive a common float type air elimination valve. Contained within the fluid tank is a flexible bladder which is filled with a gas such as air or nitrogen to match the desired pressure of the fluid contained within the tank. Expansion of the heated fluid will displace the flexible bladder and compress the gas contained therein, effectively maintaining a constant fluid pressure. A pump impeller and volute housing assembly is contained within the tank. A pump motor outside the tank is connected to the impeller by a drive shaft or other drive means extending through the side of the tank. An inlet to the volute housing opens directly into the interior of the tank. An outlet of the volute housing, which is also contained within the fluid tank, is connected to the interior side of the outlet pipe. A spring operated pressure relief valve is connected directly to the outlet side of the pump volute and opens to the interior of the tank when the fluid pressure in the outlet of the pump volute overcomes the predetermined spring tension. A second embodiment of the pump assembly includes a fluid mixing housing placed over the inlet to the pump assembly with an opening connected to the interior of the tank and an opening connected to the returning fluid. A mixing apparatus proportionally mixes hot fluid from the tank with cool returning fluid in the mixing housing before it enters the pump volute and can be either manually or automatically adjusted to achieve a desired fluid temperature at the outlet pipe. This embodiment allows mounting of a number of pump and mixing apparatii around the tank to provide several different fluid temperatures from the same tank.

DETAILED DESCRIPTION OF THE PREFERRED EMBODIMENTS

Figure 1:
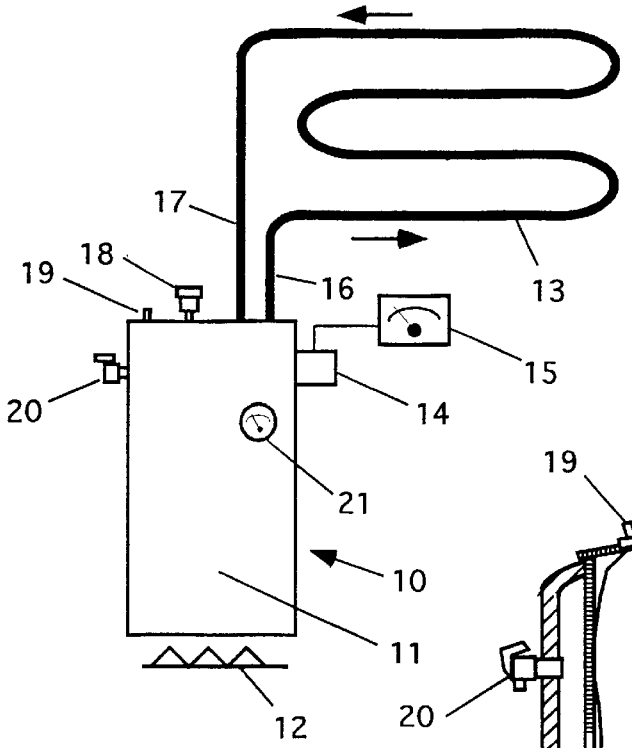
FIG. 1 is an overall pictorial diagram illustrating an environment heating system including a fluid heating and pumping apparatus in accordance with the present invention.
Figure 2:
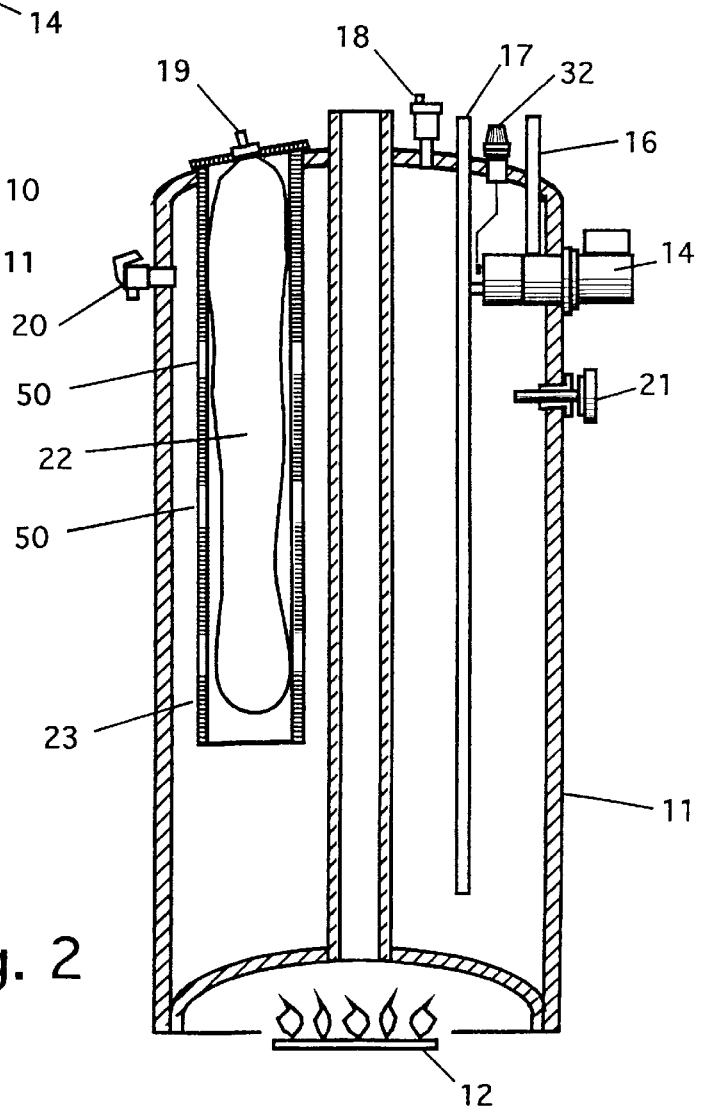
FIG. 2 is a detailed cross-sectional diagram of the fluid heating and pumping apparatus of FIG. 1.

Referring now to FIGS. 1 and 2, there is shown a diagram of an environment heating system 10 operable to heat a selected environment, such as a room, office, work area or the like. Heating system 10 includes a fluid tank 11 or similar pressure vessel to provide a source of heated fluid such as water. Fluid tank 11 may comprise a boiler, water heater or other fluid containment vessel equipped with a fluid heating device 12 such as a burner, heat exchanger, electric element or other conventional heating device. A heat transfer apparatus 13 receives the heated fluid from fluid tank 11 and transfers heat to the surrounding environment. A fluid pump and flow control apparatus 14 serves to control the circulation of fluid through heating system 10 to achieve desired environmental temperatures. A volute and impeller assembly of fluid pump and flow control apparatus 14 is immersed in the fluid contained within fluid tank 11. A thermostat or other temperature sensitive controller 15 regulates the operation of the fluid pump and flow control apparatus 14. A fluid carrying line 16, such as a conduit or pipe, connects to fluid pump and flow control apparatus 14 and the inlet of heat transfer apparatus 13. A second fluid carrying line 17 connects the outlet of the heat transfer apparatus 13 to fluid tank 11. When controller 15 activates fluid pump and flow control apparatus 14, fluid enters the volute of fluid pump and flow control apparatus 14, which is submerged in fluid tank 11, and is circulated through line 16 to heat transfer apparatus 13, though line 17, and back to fluid tank 11.

Fluid tank 11 includes an automatic air vent apparatus 18 mounted near the highest point thereof to release any air to the atmosphere which may rise to the top of the fluid contained therein. A flexible bladder 22, located within fluid tank 11, contains a gas such as air or nitrogen. A valve 19 is provided on a wall of fluid tank 11 for the purpose of inflating and sealing bladder 22. Bladder 22 has sufficient capacity to compress the gas held therein so as to accommodate the expansion of the total amount of fluid contained within heating system 10 as the fluid is heated to a predetermined temperature by fluid heating device 12. A pressure relief valve 20 may be provided in a side wall of fluid tank 11 to vent fluid when the internal tank pressure exceeds the preset limit of the relief valve, thereby relieving heating system 10 of excess internal pressure. Temperature and pressure monitoring devices 21 may be installed to indicate that heating system 10 is operating within its design limits.

Bladder 22 may comprise a flexible material such as EPDM rubber that is formed into a tubular shape as illustrated in FIG. 2. A rigid containment cylinder 23 surrounds bladder 22 and serves to limit the expansion of bladder 22 during low fluid pressure conditions within fluid tank 11. Containment cylinder 23 includes a plurality of openings 50 in communication with the fluid in fluid tank 11 for allowing the fluid to come in direct contact with bladder 22. Since containment cylinder 23 is inside fluid tank 11 and is completely immersed in the fluid contained within fluid tank 11, it need only be constructed to withstand the gas pressure of bladder 22 when expanded in the absence of fluid pressure within fluid tank 11. Heating the fluid contained within heating system 10 will cause the fluid in fluid tank 11 to expand. Expanding fluid partially collapses bladder 22 and compresses the gas held therein, thereby maintaining a generally steady fluid pressure within heating system 10.

Figure 3:
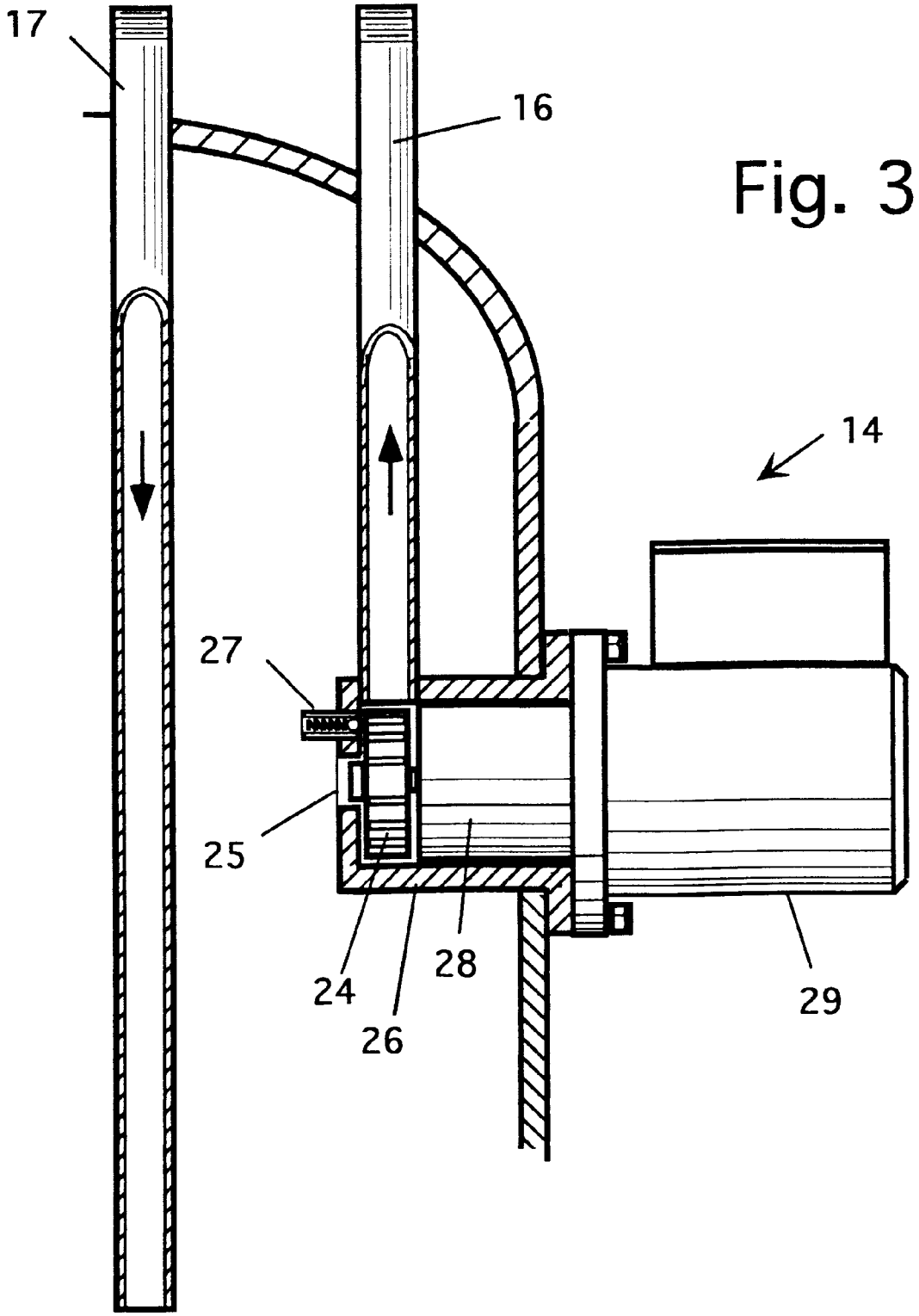
FIG. 3 is a detailed sectional diagram of the volute, impeller, bypass valve, and outlet assembly that is an integral part of the fluid heating and pumping apparatus of FIGS. 1 and 2.

Referring now to FIG. 3, there is shown a pump volute housing 26 that forms a pumping chamber contained within tank 11 and that includes an inlet 25 open to the interior of fluid tank 11 and positioned in alignment with the center of a pump impeller 24. An outlet connected to line 16 is provided in the pump volute housing 26. Pump impeller 24 is located in pump volute housing 26 and includes a central sleeve aligned with inlet 25. As impeller 24 rotates, fluid is pulled through inlet 25, discharged radially therefrom, and moved through line 16. Line 16, being coupled to pump volute housing 26 within fluid tank 11, passes through the wall of fluid tank 11 and is sealed externally at that junction to prevent any fluid from passing through the wall of fluid tank 11 at the point of coupling of line 16. Impeller 24 is driven by a motor 29, mounted external to fluid tank 11, through a fluid and pressure resistant seal 28 in the side wall of fluid tank 11. A pressure relief device 27 serves to relieve excess pressure within the pump volute housing 26 and may comprise, for example, a ball and seat valve held in place by a pretensioned spring to prevent the passage of fluid unless the fluid pressure in pump volute housing 26 exceeds the tension of the spring.

Figure 4:
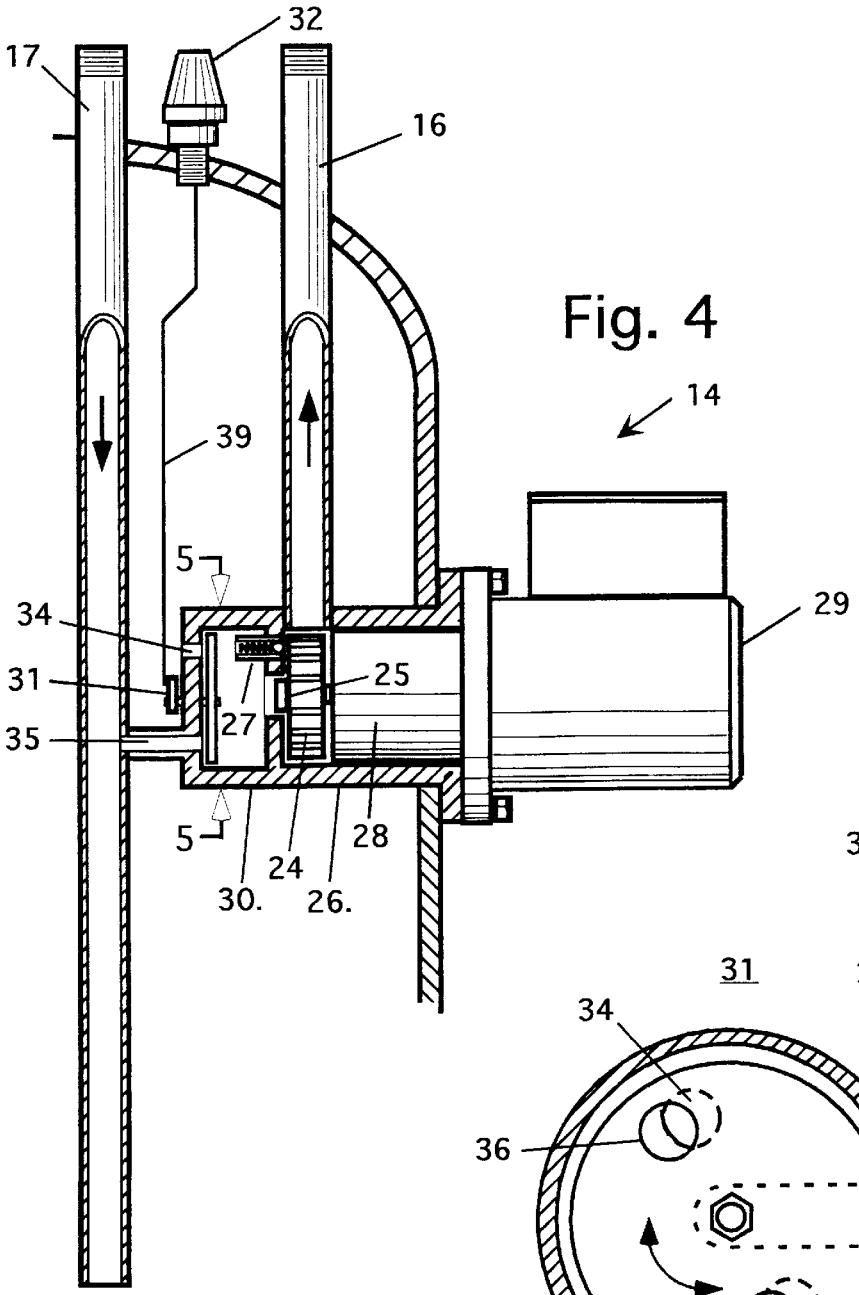
FIG. 4 is a detailed sectional diagram of an alternative embodiment of the volute, impeller, bypass valve, and outlet assembly of FIG. 3 that includes an adjacent housing for mixing cooled return fluid with heated fluid to achieve a desired fluid temperature.

Referring now to FIG. 4, there is shown an alternative embodiment of the fluid pump and control apparatus 14 of FIG. 3, which includes a fluid mixing housing 30 attached to the inlet of pump volute housing 26. Fluid mixing housing 30 includes an opening 34 that directly communicates with the interior of fluid tank 11 and another opening 35 to line 17, thereby providing a mixing chamber for heated fluid from fluid tank 11 and cool fluid returning through line 17. A valve 31, operated by an adjustable device 32, allows heated fluid from fluid tank 11 and cool fluid from line 17 to enter the fluid mixing housing 30 in direct but opposite proportions. As the flow of heated fluid is increased, the flow of cool fluid is decreased in the same proportion. Adjustable device 32 may be operated manually or automatically via a motorized apparatus and temperature sensing device.

Figure 5:
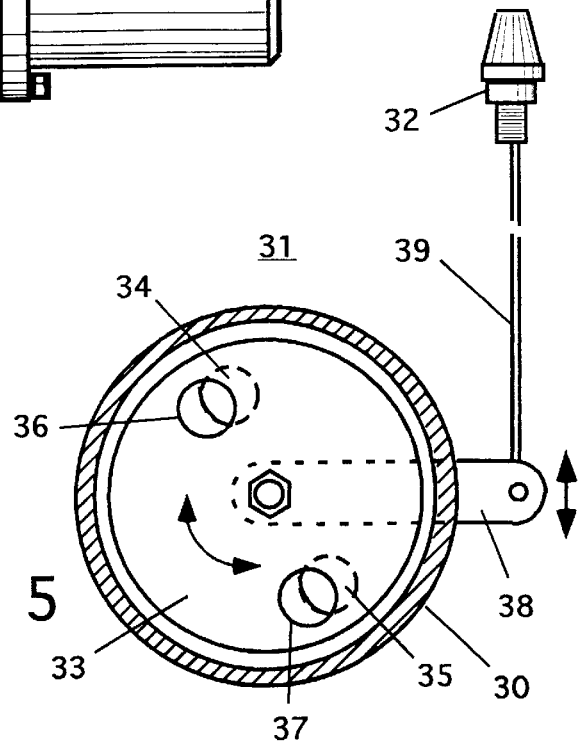
FIG. 5 is a cross-sectional diagram of the fluid mixing housing taken along the line 5—5 of FIG. 4.

Referring now to FIG. 5, there is shown an embodiment of valve 31 including a rotatable disc 33 having openings 36 and 37 corresponding and communicating with fixed openings 34 and 35, respectively and proportionally. One end of a lever arm assembly 38 is attached to the center shaft of disc 33, and the other end is attached to a connecting rod 39 which transfers the vertical movement from adjustable device 32 to lever arm 38, thereby causing disc 33 to rotate accordingly. Housings for the fluid pump and control apparatus of FIG. 4 need only be constructed to withstand the low pressure differential between the fluid inside fluid tank 16 and pumped fluid.

I claim:

1. A fluid heating and pumping apparatus for providing heated fluid to a plurality of heat transfer components of a space heating system, comprising:

a fluid tank for receiving and containing a quantity of fluid;

heating means for heating the fluid contained within the fluid tank;

an outlet line for conveying heated fluid from the fluid tank to the heat transfer components;

an inlet line for conveying return fluid from the heat transfer components to the fluid tank;

means mounted through a top wall of the fluid tank for for automatically venting gas therefrom;

a collapsible bladder disposed within the fluid tank for absorbing expansion of heated fluid within the fluid tank;

valve means for facilitating filling of the bladder with a gas from outside the fluid tank;

rigid containment means mounted within the fluid tank so as to surround the bladder, the containment means having a plurality of openings therein communicating with the fluid inside the fluid tank, the containment means serving to contain the gas-filled bladder when the pressure of the fluid within the fluid tank is less than the pressure of the gas within the bladder.

2. A fluid heating and pumping apparatus as in claim 1, further comprising pumping means having a volute housing and impeller disposed within the fluid tank and immersed in the fluid contained therein, the volute housing having an opening directly to the interior of the fluid tank and an outlet connected to said outlet line.

3. A fluid heating and pumping apparatus as in claim 2, further comprising a mixing chamber for receiving cooled return fluid from the heat transfer components and heated fluid from the fluid tank.

4. A fluid heating and pumping apparatus as in claim 3, further comprising regulation means operable for proportionally regulating the flow of cooled return fluid and heated fluid entering said mixing chamber.

5. A fluid heating and pumping apparatus as in claim 4, further comprising a pressure relief mounted on the volute housing for releasing excess fluid pressure within the volute housing into the fluid tank.

* * * * *